US005896626A

United States Patent [19]

Birkenstock

[11] Patent Number: 5,896,626

[45] Date of Patent: Apr. 27, 1999

[54] CLIP CLASP FOR SECURING A STRAP

[75] Inventor: Christian Birkenstock, Bad Honnef, Germany

[73] Assignee: Betula Schuh GmbH, St. Katharinen, Germany

[21] Appl. No.: 08/919,358

[22] Filed: Aug. 28, 1997

[30] Foreign Application Priority Data

Sep. 5, 1996 [DE] Germany ..... M9607629

[51] Int. Cl.[6] ..... A44B 11/22

[52] U.S. Cl. ..... 24/175; 24/177; 24/180

[58] Field of Search ..... 24/163 R, 175, 24/176, 177, 180

[56] References Cited

U.S. PATENT DOCUMENTS

| | | | |
|---|---|---|---|
| 1,856,775 | 5/1932 | Meehan | 24/180 |
| 1,856,776 | 5/1932 | McDermott et al. | 24/180 |
| 2,091,685 | 8/1937 | Meehan | 24/180 |
| 3,886,632 | 6/1975 | Bako | 24/180 X |
| 5,189,763 | 3/1993 | Voumard | 24/175 |

FOREIGN PATENT DOCUMENTS

| | | | |
|---|---|---|---|
| 208598 | 2/1940 | Switzerland | 24/180 |
| 246067 | 12/1946 | Switzerland | 24/180 |
| 229873 | 3/1925 | United Kingdom | 24/180 |

*Primary Examiner*—James R. Brittain

*Attorney, Agent, or Firm*—Pollock, Vande Sande & Amernick, R.L.L.P.

[57] ABSTRACT

A clasp for fastening together opposing distal portions of upper and lower segments of flexible material, such as the straps of a shoe or sandal. The clasp has an upper part pivotally connected to a lower part by a hinge structure comprised of portions of proximate sidewalls of the parts, and a clip structure comprising an outwardly facing recess in a distal sidewall of one of the parts and a resilient inwardly arched section of a distal sidewall of the other part arranged to snap into and engage the recess when positioned opposite thereto. This snap action secures the upper part to the lower part in a closed position of the clasp. The lower part includes a holding pin mounted on a bottom wall of the lower part for insertion through corresponding holes in the flexible segments to prevent relative movement between these segments when the clasp is closed. The pin may have a radially projecting concentric skirt forming a stop shoulder for engaging the upper surface of the lower flexible segment after the skirt has passed through the hole of this segment so as to hold the clasp on the lower segment when the clasp is in its open position. A pair of holding pins with radial skirts may be provided for a lower segment with two holes and an upper segment with a series of holes where adjacent holes in the series are spaced apart by the same distance as the holding pins.

19 Claims, 2 Drawing Sheets

CLIP CLASP FOR SECURING A STRAP

TECHNICAL FIELD

The present invention relates to fasteners for securing together the ends of straps and the like, and more particularly to securing together two strap segments or one strap segment and another portion of the upper of sandals, shoes, and other footwear.

BACKGROUND OF THE INVENTION

The opposing portions of the uppers of shoes are often adjustably secured together across the top of the foot with a pair of shoe strings. Another means of adjustably securing the uppers together across the top of the foot are buckles which usually join together opposing extensions of the upper in the form of straps. Conventional buckles are often unattractive and clumsy to operate. There is therefore a need for an attractive fastener that is easy to operate for adjustably securing together either two opposing strap extensions of the upper or one strap extension and an opposing edge portion of the upper.

SUMMARY OF THE INVENTION

The present invention provides a clip clasp, particularly for shoes and sandals, for fastening together the distal ends of two opposing strap segments, or the distal end of one strap segment and an opposing edge segment of the upper, each having at least one hole therethrough for receiving a holding pin of the clasp. The clasp comprises a lower part having at least one centrally located and perpendicularly extending holding pin mounted on a substantially flat upper surface of a bottom wall, and an upper part pivotally connected by a proximate sidewall to a proximate sidewall of the lower part through a hinge structure. For the purpose of constantly supporting the clip clasp on a shoe or sandal upper, the holding pin has a concentric radially protruding skirt, the lower surface of which forms a stop shoulder for holding the clasp in place by engaging the upper surface of the lower strap or other opposing portion of the upper after the skirt and a lower segment of the holding pin have passed through the hole therein. After the lower part is thus secured, an upper segment of the holding pin is passed through a corresponding hole in an opposing upper strap so that the upper strap can be fastened to the lower strap or a lower segment of the upper. After the lower part of the clasp is thereby placed in its securing position, the upper part can be pivoted toward the lower part and a distal sidewall of the upper part can be moved laterally outward over an opposing distal sidewall of the lower part. The upper distal sidewall has an inwardly arched clip section which is resiliently flexible in an elastic manner and therefore can be snapped into or out of a longitudinal recess arranged in the lower distal sidewall.

A clip clasp housing is formed by the closed upper and lower parts and has a generally rectangular shape. The upper part opens laterally by way of pivoting away from the lower part around the pivotal hinge structure which is formed by a hinge pin passing through a boss on the proximate sidewall of the lower part and a pair of spaced apart ears on the proximate sidewall of the upper part, this hinge structure being opposite to the clip side of the housing. Although one perpendicular holding pin operates satisfactorily, the clip clasp preferably utilizes two perpendicular holding pins located along an axis substantially midway between the lower distal sidewall and the lower proximate sidewall on the bottom wall of the lower part. Each holding pin has a concentric radially protruding skirt forming a stop shoulder for engaging the upper surface of the lower strap or segment of the shoe or sandal upper. It is also contemplated that the proximate sidewalls of the upper and lower parts may be exchanged such that the hinge boss is on the upper part and the hinge cars are on the lower part.

BRIEF DESCRIPTION OF THE DRAWINGS

The construction, operation and advantages of the present invention may be understood and appreciated more fully from the detailed description below taken in conjunction with the accompanying drawings, in which.

DETAILED DESCRIPTION OF PREFERRED EMBODIMENTS

Figures 1, 2, 3, 4, 5, 6:
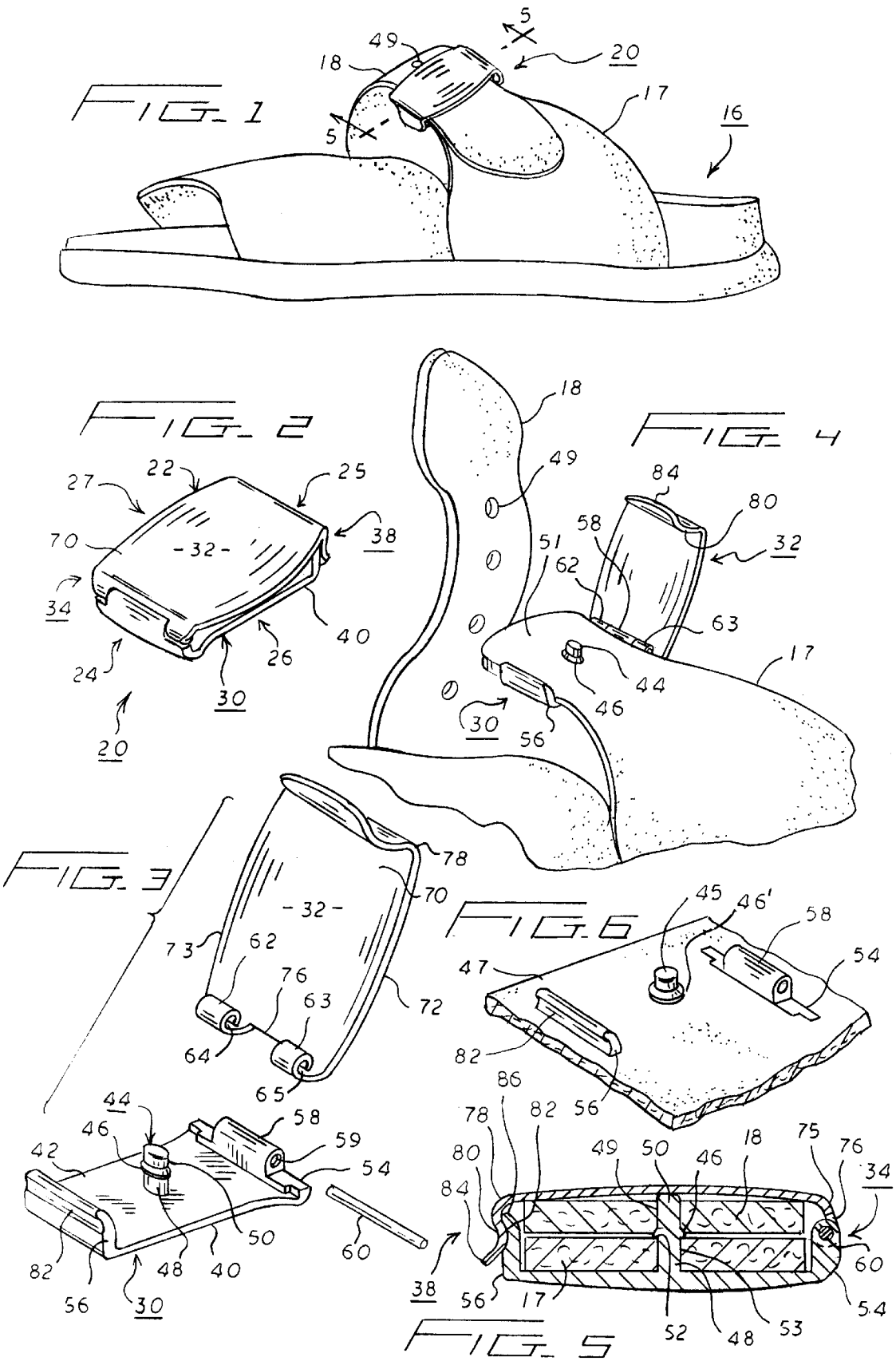
FIG. 1 is a perspective view from the front and left side of a sandal with its straps fastened together by the clasp of the invention.
FIG. 2 is a perspective view from the rear and right side of the clasp alone in its closed position.
FIG. 3 is an exploded perspective view from the front and left side of the clasp alone in its open position.
FIG. 4 is a fragmentary view showing the clasp of FIG. 3 in its open position and attached to the lower strap of the sandal.
FIG. 5 is a cross-sectional view taken along lines 5—5 of FIG. 1 and showing the closed clasp securing together the opposing straps of the sandal.
FIG. 6 is a fragmentary view showing a modification of the clasp of the invention and a modified use thereof.

In FIG. 1, there is shown a sandal 16 having the end portions of a pair of opposing straps 17 and 18 secured together by a clasp 20 made in accordance with the present invention. As shown in FIGS. 2–5, the clasp comprises a housing 22, which has in its closed condition a narrow proximate side 24, a narrow distal side 25, and two broad sides forming opposite openings 26 and 27 for passage of the straps 17 and 18 through the housing. Since the broad sides are longer than the narrow sides, the broad sides define the length and the narrow sides define the width of the clasp.

The housing 22 comprises a generally rectangular lower part 30 and a generally rectangular upper part 32 of different transverse dimensions, the bottom wall 40 of lower part 30 being more narrow than the top wall 70 of upper part 32 in the width direction that the straps pass through the openings 26 and 27. The lower part 30 and the upper part 32 are articulated relative to each other at the proximate side 24 by a pivotal connection in the form of a hinge structure, generally designated 34. When the clasp is in its closed condition, the upper and lower parts 30 and 32 are locked together on the narrow distal side 25 by a clip structure, generally designated 38, forming a snap closure for securing the clasp in its closed condition.

In order to attach the open clasp in a fixed relationship to the lower strap 17, or a segment of a shoe upper taking its place, a holding pin 44 extends perpendicularly upward from a substantially flat surface 42 of a generally rectangular base 40. The holding pin 44 has a radially protruding concentric skirt 46 dividing the pin into a lower pin segment 48 and an upper pin segment 50. The pin 44 and the skirt 46 have oval cross sections, as do the strap holes 49 and 53, and the major and minor axes of the skirt cross section are substantially greater than the major and minor axes of the strap holes 49 and 53. The lower surface of skirt 46 therefore provides a stop shoulder 52 for engaging the upper surface 51 of lower strap 17 to keep the pin 44 in the hole 53 of the lower strap, and thereby support the clasp 20 on the lower strap 17 when the clasp is in its open condition as shown in FIG. 4.

Extending along the respective opposite narrow ends 24 and 25 of the lower clasp part 30 are a proximate sidewall 54 and a distal sidewall 56 as shown in FIGS. 3 and 5. The proximate sidewall 54 includes a central hinge boss 58 having a passage 59 for rotatably receiving an articulation pin 60 that forms the pivot joint of hinge 34 when corresponding ears 62 and 63 on the proximate sidewall 54 of the upper clasp part 34 are bent around and crimped onto the respective ends of the hinge pin 60. The cars 62 and 63 define respective passages 64 and 65 for receiving and securely engaging the hinge pin 60. The distal sidewall 56 forms a part of the snap-closure clip 38 as described more fully below. Although the cross-sectional shape of the pin 44 and the skirt 46 are shown as being oval in FIG. 3, they may instead be round as shown by the pin 45 and skirt 46' in FIG. 6, or have some other cross-sectional shape, such as square or rectangular.

The bottom wall 40 of the lower clasp part 30 may be supported on a narrow portion of the lower strap 17 of the footwear as shown in FIG. 4. In this arrangement, the lower sidewalls 54 and 56 of the lower part 30 are aligned with the respective edges of the strap and project past these edges and beyond the outer surface 5 1 of the strap so as to remain in constant alignment therewith. Alternatively, instead of being attached to the narrow strap 17, the clasp may be attached to a much wider section 47 of one side of the shoe upper by forming corresponding slots in the shoe upper for receiving the lower sidewalls 54 and 56 so that these sidewalls may penetrate the upper of the footwear as shown in FIG. 6. Thus, the invention is also applicable to fastening the single strap of a shoe to an opposing section 47 of a shoe upper wherein the lower proximate wall 54 and the lower distal wall 56 are inserted through corresponding slots in the shoe upper section so as to be held in position therein by the skirt 46' when the holding pin 45 and its skirt 46' are also inserted through a corresponding hole in the shoe upper section. In this modification, the height of the proximate and distal lower walls 54 and 56 relative to the thickness of the upper section 47 are such that the lip 84 of the clip 38 and the pin 60 of the hinge 34 are positioned above the upper surface of the upper section 47 so as to be freely operable in accordance with the principles described below.

The upper part 32 of the clasp comprises the generally rectangular top wall 70, which has protruding edge portions 72 and 73 along the broad sides thereof for stiffening the same and for engaging the outer surface of the upper strap 18. At the respective narrow sides of the top wall 70 are a downwardly extending proximate sidewall 75 and a downwardly extending distal sidewall 78. The upper proximate sidewall 75 has a central cutout 76 to receive the boss 58 on the lower clasp part 30 and to form a pair of tabs that are bent back on themselves to form the ears 62 and 63. The ears 62 and 63 cooperate with the boss 58 and the pin 60 to form the articulated hinge 34 as already described.

The upper distal sidewall 78 forms part of the clip structure 38 of the clasp and comprises an inwardly arched wall section 80 forming a clip element for engaging a correspondingly shaped recess 82 on the outer side of the lower distal sidewall 56 of lower clasp part 30. The upper distal sidewall 78 is made of a resilient material, such as steel or brass, and is sufficiently thin-walled to be resiliently flexible (elastic) for lateral movement of the arched section 80 when being engaged with and disengaged from the recess 82. Although the entire upper part 32 is shown as being made of the same resilient material as the upper distal sidewall 78, this need not be the case, such as where a resilient sidewall is carried on a top wall of more rigid material.

Although this also need not be the case, the lower distal sidewall 56 is preferably thicker and more rigid than the upper distal sidewall 78, such that, when closing the clasp, sidewall 78 is brought laterally outwards beyond the lower distal sidewall 56 to cause the inwardly arched section 80 to slip over the rounded upper edge 86 and thereby enter and engage with a snap action the recess 82 to lock the clasp in its closed condition. The end portion of the sidewall 78 beyond the arch 80 projects outwardly to form a lip 84 that serves two functions. The first function is to guide the arch 80 over the rounded edge portion 86 of the lower distal wall 56 as downward pressure is applied to the top wall 70 of the upper part 32 to close the clasp. The second function of the lip 84 is to provide a finger grip for pulling arch 80 out of recess 82 when opening the clasp.

In FIGS. 7–11, there is shown a modification of the invention wherein a lower clasp part 30' has a bottom wall 40' on the upper surface 42' of which are supported a pair of perpendicular and parallel holding pins 88 and 89, each having a radially projecting skirt 46' with a stop shoulder 52' on its underside. The holding pins 88 and 89 have a round cross section and each pass through a corresponding round hole in the lower sandal strap 17' where they are held in position by the stop shoulder 52' of the skirt 46' that also has a round cross section. The advantage of this arrangement over that shown in FIGS. 1–6 is that the dual post 88 and 89 hold the clasp more securely against rotation in the plane of the bottom wall 40'. In the upper strap 18' are a series of holes 94 that are spaced apart precisely by the distance at which the pins 88 and 89 are spaced apart along a central width axis approximately at the mid-point of bottom wall 40', so that both of the pins are simultaneously engaged by corresponding holes 94 in the upper strap 18' as may be seen best in FIG. 9. The remaining elements of the clip clasp 20' are essentially the same as those previously described for the embodiment of FIGS. 1–5, and therefore bear the same numerical designations in FIGS. 7–11 of the drawings.

The clip clasp of the invention may be operated in the following manner. To close the uppers of a sandal or shoe over the top of a foot by using the clip clasp 20 or 20', the lower clasp part 30 or 30' is fixed to the lower strap 17 or 17', or to an equivalent lower shoe upper section 47 having slots for the proximate sidewall 54 and the distal sidewall 56, by means of the skirt 46 or 46'. The skirt is pressed by its holding pin through a corresponding hole in the lower strap having the smaller diameter of the lower pin segment, such that the stop shoulder 52 or 52' rests on the upper surface of the lower strap or shoe upper section. At this time, the lower surface of the strap 17 or upper section 47 rests on the upper surface of bottom wall 40 or 40' of the lower clasp part 30 or 30'. Depending on the foot size of the wearer of the sandal or shoe, the appropriate hole 49 or appropriate pair of holes 94 is placed over the upper segment of the pin 44 or the pins 88 and 89 so that the skirt 46 or 46' is between the inner strap 17 or upper section 47 and the outer strap 18 or 18', as illustrated best in FIGS. 5 and 11.

Figure 8:
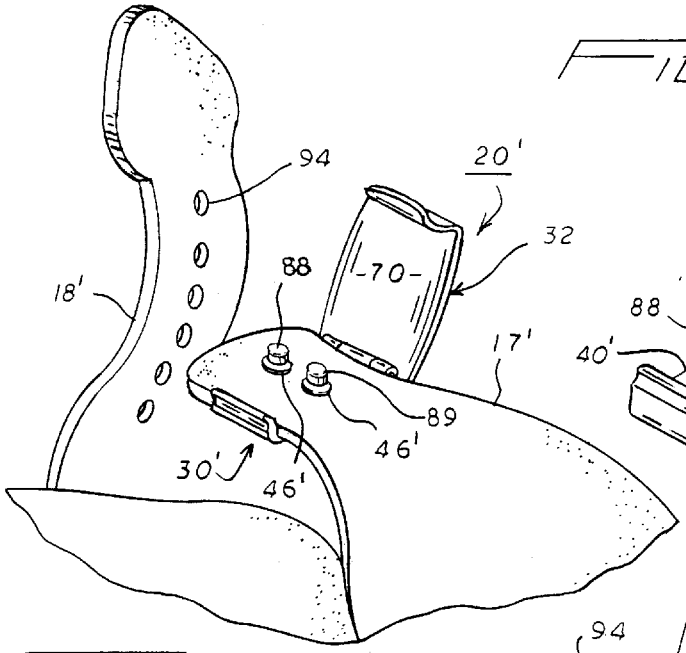
FIG. 8 is a perspective view showing the modified clasp of FIG. 7 in its open position with the holding pins engaged with the lower strap of the sandal.
Figure 7:
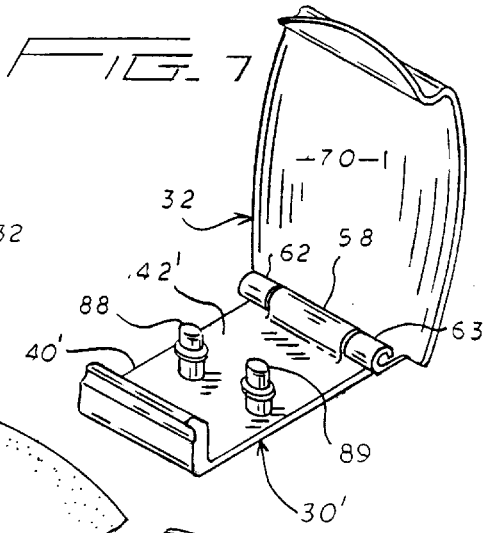
FIG. 7 is a perspective view of another modification of the clasp of the invention wherein two parallel holding pins are provided.
Figure 9:
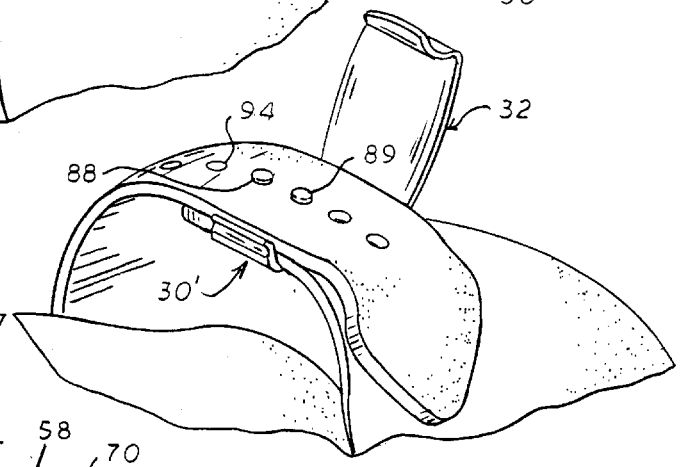
FIG. 9 is a perspective view of showing the modified clasp of FIG. 7 in its open position with the holding pins engaged with both the lower and upper straps of the sandal.
Figure 10:
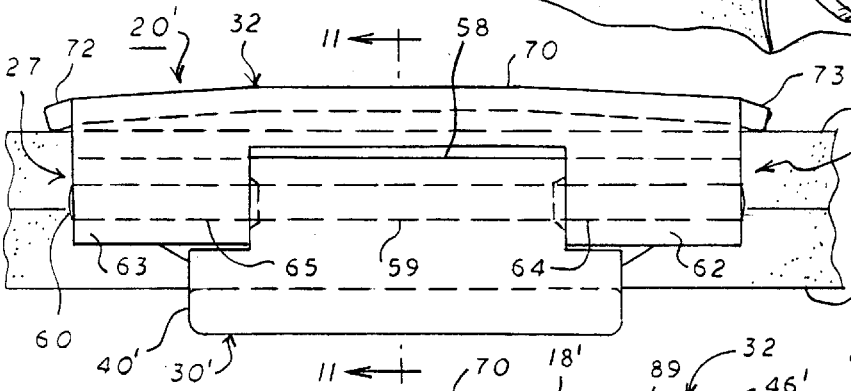
FIG. 10 is a rear end view in elevation of the modified clasp of FIG. 7 in its closed position and showing fragments of the sandal straps.
Figure 11:
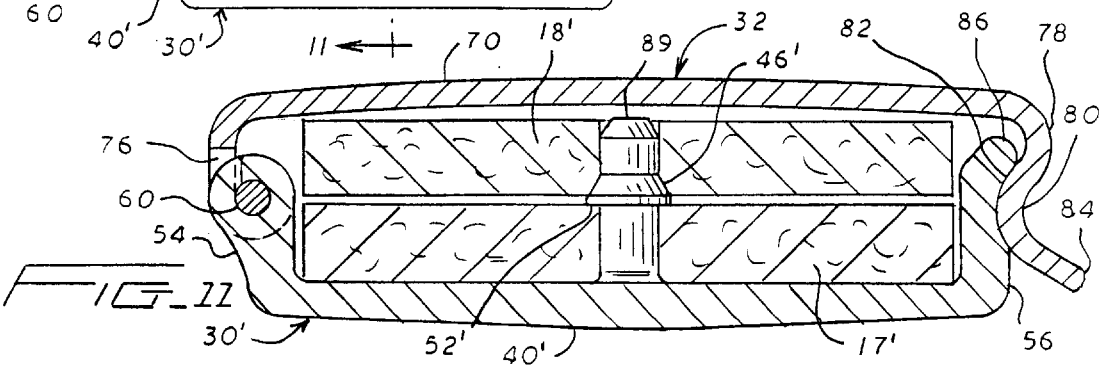
FIG. 11 is a cross sectional view taken along lines 11—11 of FIG. 10.

In other words, with reference to FIGS. 8 and 9, the lower and upper straps 17' and 18' are pulled in opposite directions to get the appropriate length of overlap between the lower and upper straps, and then a narrow length of the upper strap 18' is pushed between the opposite sidewalls 54 and 56 of the lower clasp part 30' until the upper pin segments of pins 88 and 89 engage and fully penetrate the appropriate pair of holes 94 in the upper strap. With this done, the upper clasp part 32 is pivoted downward toward the lower clasp part 30' and its top wall 70 is pushed downward to force the arched clip section 80 over the rounded upper edge 86 of the lower distal sidewall 56 so that section 80 snaps into the correspondingly shaped recess 82 to produce the closed position of the clasp. Because of the resilient flexibility of the upper distal sidewall 78, the arched section 80 is first moved laterally outwards over the rounded end 86, and then snaps laterally inward into the recess 82.

In opening the clasp, the arched section 80 moves in reverse fashion in response to upward finger pressure on the lip 84, which causes the arched section 80 to move laterally outward so that it can be articulated past the rounded edge 86 of the lower distal sidewall 56 to pivot the upper part 32 of the clasp to its open position shown in FIG. 9. In this regard, the resiliency of the distal upper sidewall 78 is such that the arched section 80 can be snapped into and out of the elongated recess 82 in an elastic manner. In the open condition of the clasp, the upper strap 18' can be removed from the holding pins 86 and 89 as shown in FIG. 8.

While the invention has been described above in conjunction with the preferred embodiments thereof, many changes, modifications, alterations and variations will be apparent to those skilled in the art when they learn of the invention. Thus, although the invention is described in conjunction with fastening together the straps of a sandal or one strap of a shoe and an opposing section of a shoe upper, it is also applicable to fastening together various other types of straps. For example, the clasp may be used to fasten together the end segments of a belt, sash or the like. Accordingly, the preferred embodiments of the invention as set forth above are intended to be illustrative, not limiting, and various changes may be made without departing from the spirit and scope of the invention as defined by the claims set forth below.

What is claimed is:

1. A clasp for fastening together two opposing distal portions of flexible material when an upper segment of one is overlapped with a lower segment of the other and each has at least one hole passing therethrough, said clasp comprising:

an upper part pivotally connected to a lower part by a hinge structure including a hinge piece extending between a portion of a proximate sidewall of said lower part and a portion of a proximate sidewall of said upper part; and, a clip structure including a distal sidewall of said lower part and a distal sidewall of said upper part;

wherein one of said distal sidewalls has an outwardly facing recess and the other of said distal sidewalls is made of a resilient material and has an inwardly arched section arranged to snap into and thereby engage said recess when opposite thereto to secure said upper part over said lower part to form a housing in a closed position of the clasp, wherein said upper part further includes a top wall connecting the distal and proximate sidewalls thereof to form a first housing part for receiving the upper segment when the clasp is in said closed position, wherein said lower part further includes a bottom wall connecting the distal and proximate sidewalls thereof to form a second housing part for receiving the lower segment when the clasp is in said closed position, wherein said closed clasp provides a housing having two opposing openings for passing the segments therethrough from opposite directions to form only two layers of the flexible material in contact with said housing, wherein said lower part further includes at least one upright holding pin mounted on upper surface of said bottom wall connecting the distal and proximate sidewalls of said lower part, wherein said holding pin is adapted to be inserted into a corresponding hole in each of the overlapped flexible segments when said upper part is pivoted away from said lower part in an open position of the clasp, and to be retained in the corresponding holes for preventing relative movement between the overlapped flexible segments when the clasp is in said closed position, wherein said holding pin includes a radially projecting concentric skirt on an intermediate portion thereof, said skirt providing a stop shoulder on its underside for engaging an upper surface of the lower flexible segment, and a radial dimension of said skirt being substantially larger than a radial dimension of said corresponding hole in the lower segment so that said skirt supports the clasp on the lower segment when the clasp is in said open position and the intermediate portion of said pin with said skirt has been inserted through said corresponding hole in the lower segment, and wherein the clasp is removable from the opposing distal portions of flexible material when the clasp is in said open position.

2. A clasp according to claim 1, wherein said holding pin is positioned on said bottom wall substantially midway between said lower distal sidewall and said lower proximate sidewall.

3. A clasp according to claim 1, wherein a pair of said holding pins are mounted on the upper surface of said bottom wall and are adapted to be inserted simultaneously through a corresponding pair of holes in the lower flexible segment and a corresponding pair of holes in the upper flexible segment when said clasp is in its open position.

4. A clasp according to claim 3, wherein said pair of pins are parallel and spaced apart on said bottom wall along an axis substantially midway between said lower distal sidewall and said lower proximate sidewall, and wherein the upper flexible segment has a series of more than two spaced apart holes each adapted to receive one of said pins, and wherein the spacing between adjacent holes of said series is substantially equal to the spacing between said pair of parallel pins.

5. A clasp according to claim 1, wherein said hinge structure comprises a boss on said lower proximate wall and a pair of ears on said upper proximate wall, wherein said hinge piece is a hinge pin, and wherein said boss and said ears each have a passage for receiving said hinge pin.

6. A clasp according to claim 5, wherein said arched section is on the upper distal sidewall and said recess is on the lower distal sidewall.

7. A clasp according to claim 1, wherein said arched section is on the upper distal sidewall and said recess is on the lower distal sidewall.

8. A clasp according to claim 1, wherein the upper surface of said bottom wall has a shape conforming substantially to the shape of a lower surface of the lower flexible segment.

9. A clasp according to claim 8, wherein each of said shapes is substantially flat.

10. A clasp according to claim 1, wherein the upper and lower flexible segments are each comprised of a portion of an upper of a shoe or sandal.

11. A clasp according to claim 10, wherein at least one of the flexible segments is a strap portion of the shoe or sandal upper.

12. A clasp according to claim 10, wherein the upper flexible segment is a strap portion of the shoe upper and the lower flexible segment is an opposing section of the shoe upper having a pair of slots therein, wherein said lower proximate sidewall is arranged to be received in one of the slots and has a height sufficient for said hinge pin to be above an upper surface of the lower flexible segment, and wherein said lower distal sidewall is arranged to be received in the other slot and has a height sufficient for said recess to be above the upper surface of the lower flexible segment when said holding pin is fully inserted in the corresponding hole of the lower flexible segment.

13. A clasp according to claim 10, wherein the upper and lower flexible segments comprise narrow straps extending from opposing portions of the shoe or sandal upper.

14. A clasp according to claim 1, wherein said holding pin has a round transverse cross section.

15. A clasp according to claim 1, wherein said holding pin has an oval transverse cross section.

16. A clasp according to claim 1, wherein the top wall of said upper part and the bottom wall of said lower part have length dimensions that are approximately equal, and wherein said top wall has a width dimension substantially greater than a corresponding width dimension of said bottom wall.

17. A clasp according to claim 16, wherein said top wall is made of a resilient material.

18. A clasp according to claim 1, wherein the stop shoulder of said skirt has a height from the bottom wall of said lower part substantially the same as a height from said bottom wall to the hinge piece of said hinge structure.

19. A clasp according to claim 18, wherein said recess is in the distal sidewall of said lower part and extends to a height from the bottom wall of said lower part substantially above a maximum height of said skirt from said bottom wall.

* * * * *